United States Patent [19]

Bradley

[11] 3,966,213

[45] June 29, 1976

[54] GOLF TEE DEVICE

[76] Inventor: John G. Bradley, 1800 Lakewood Court, Eugene, Oreg. 97402

[22] Filed: Apr. 3, 1975

[21] Appl. No.: 564,686

[52] U.S. Cl. ..... 273/201; 124/50

[51] Int. Cl.[2] ..... A63B 57/00; A63B 69/36

[58] Field of Search ..... 273/201

[56] References Cited

UNITED STATES PATENTS

| | | | |
|---|---|---|---|
| 1,667,481 | 4/1928 | Lange et al. | 273/201 |
| 1,695,006 | 12/1928 | Brockhagen | 273/201 |
| 1,952,113 | 3/1934 | Beckett | 273/201 |
| 2,127,282 | 8/1938 | Beckett | 273/201 |
| 2,152,680 | 4/1939 | Blaski | 273/201 |
| 2,295,599 | 9/1942 | Mozel | 273/201 |
| 2,530,698 | 11/1950 | Hogeberg | 273/201 |
| 2,711,321 | 6/1955 | Mc Graw, Sr. | 273/201 |
| 3,448,985 | 6/1969 | Scott | 273/201 |

*Primary Examiner*—Richard C. Pinkham
*Assistant Examiner*—Harry G. Strappello
*Attorney, Agent, or Firm*—James D. Givnan, Jr.

[57] ABSTRACT

A teeing device utilizing hopper storage of golf balls for gravitational passage of a ball past a toggle like ball release mechanism for ball placement on a reciprocating tee assembly. A platform supports the hopper structure and provides a supporting surface for the golfer and is preferably supported in a removable manner enabling reorientation of the platform and hopper to suit right or left handed golfers with respect to a driving range or the like. An oscillating arm is driven through a cycle of operation by a circular cam plate on which a switch arm rides. A mercury switch carried by the arm closes a motor circuit upon the golfer momentarily depressing one end of the switch arm with the rotating cam plate thereafter retaining the switch arm in an inclined, switch closing position until a follower on the switch arm again seats within a cam plate recess.

3 Claims, 6 Drawing Figures

GOLF TEE DEVICE

BACKGROUND OF THE INVENTION

The present invention relates generally to that class of devices for teeing a golf ball, such devices commonly being found on golf practice ranges and in some instances, are privately owned. A review of the prior art indicates numerous devices for automatic teeing of golf balls, the devices intended primarily to obviate the distracting task of repeatedly teeing up the golf ball resulting in an interruption of the golfer's concentration. Considering the art generally, it consists of complex devices of high manufacturing cost and requiring considerable maintenance. Another drawback to a number of known teeing devices is that they are restricted to either left or right hand golfers and are not readily convertible to one or the other. A further drawback to such prior devices is the lack of means permitting ready adjustment of tee height.

SUMMARY OF THE INVENTION

The present teeing device is incorporated into a golfing platform including a ball storage hopper with the feeding of golf balls to the teeing device being via a manually actuated switch below the platform surface. The present teeing mechanism is incorporated in a unitary manner with the hopper and platform structure being repositionable to relocate the raised hopper structure to permit either right or left handed golfers to utilize the device. A circular cam plate on which a follower rides serves to open and close a mercury switch to intermittently drive a motor powering the cam plate. A ball lifting mechanism comprises an arm pivotally coupled to the cam plate, at a point adjacent its periphery, to impart rocking motion to said arm which rocks about a pivot support located approximately at the arm center.

Important objects of the present automatic golf tee include the provision of: an automatic tee capable of teeing up golf balls including switch means disposed so as to be selectively actuated by the golfer without removing his hands from the golf club; an automatic tee for use by either right or left handed golfers wherein a golf ball hopper and additional structure are unitary with a supporting platform to permit proper orientation of the platform to an adjacent practice area or driving range; an automatic tee incorporating a pair of reciprocating members which operate in a toggle like manner to successively release golf balls from an entrained supply of balls; an automatic tee incorporating a tee assembly within which may be mounted tees of different heights; an automatic tee wherein components have been reduced in number with each being of a highly reliable nature resulting in a low production cost and relatively maintenance free for use and ownership on a private basis; an automatic tee of silent operation to avoid golfer distraction.

DESCRIPTION OF THE PREFERRED EMBODIMENT

Figure 1:
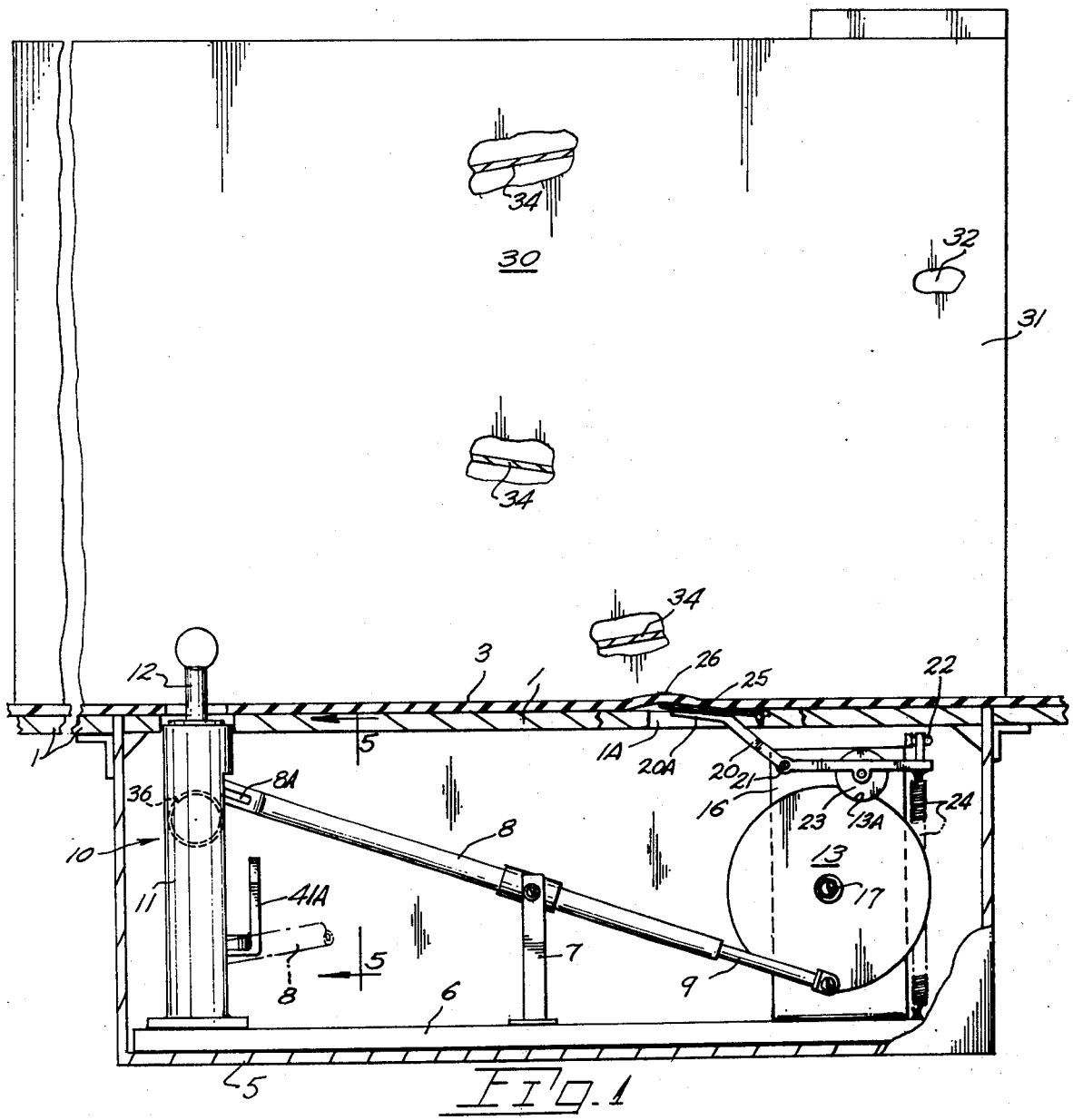
FIG. 1 is a side elevational view of the present automatic tee.

Subject matter disclosed herein was the subject of Disclosure Document No. 030,186 filed March 27, 1974.

With continuing reference to the accompanying drawings wherein applied reference numerals indicate parts similarly identified in the following specification, the reference numeral 1 indicates a platform on which a golfer stands. The platform, which may be of rigid plywood, is customarily provided with a resilient mat 2 for footing purposes. A flexible strip 3 provides a scuff surface to protect the club head immediately prior to and during contact with the ball. Platform 1 is intended for placement in a removable manner within a surface 4 shouldered at 4A to provide a recess to receive automatic tee components in place on the platform underside. Said surface may be embodied in a permanent type concrete structure or alternatively in a portable fabricated structure of rectangular configuration.

Secured to the underside of platform 1 is a base 5 of box-like configuration defining an area for reception of the following described components. In place within the box-like base is a base component 6 which serves to mount an arm support 7 which in turn pivotally carries an arm 8. The distal end of arm 8 is bifurcated at 8A to provide a lost motion coupling with ball guide means indicated generally at 10 including a cylindrical guide 11 with arm 8 imparting reciprocal movement to a tee assembly enabling a flexible tee 12 to be raised into position. The tee assembly will be described later in detail.

Figure 2:
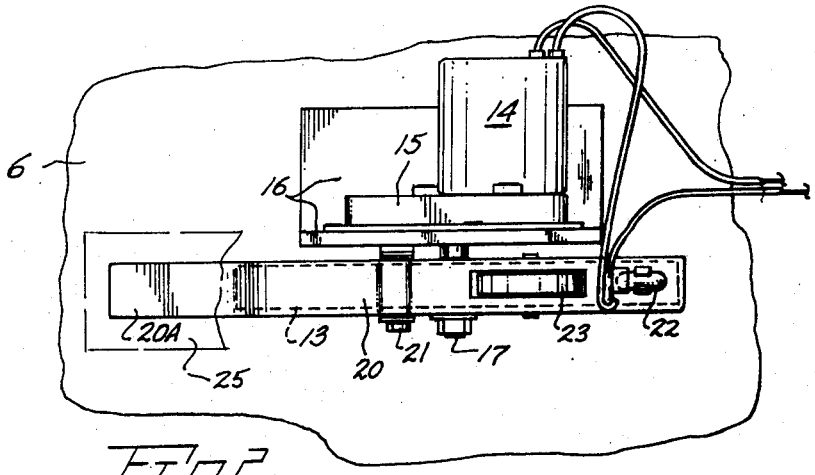
FIG. 2 is a plan view of a switch arm subjected to both manual actuation and actuation by a subjacent cam plate.
Figure 3:
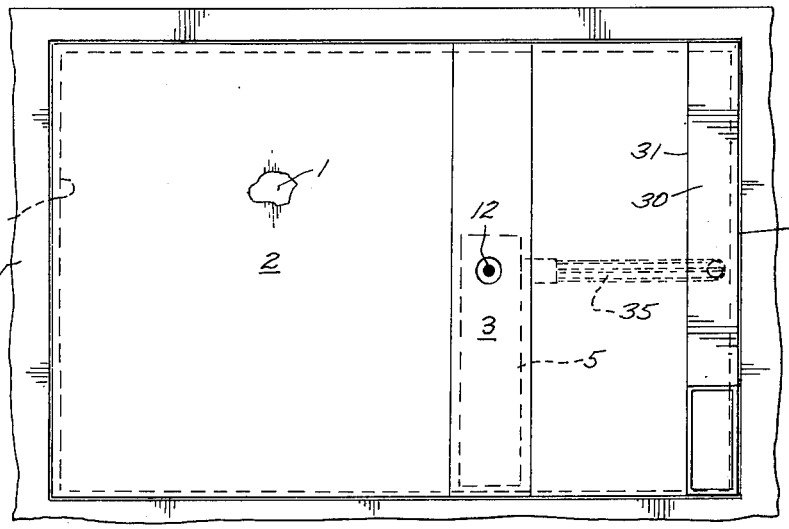
FIGS. 3 and 4 are plan views of the automatic tee embodying the present invention including a platform and ball hopper removably mounted in a supporting surface permitting reorientation for right or left handed golfers respectively.
Figure 4:
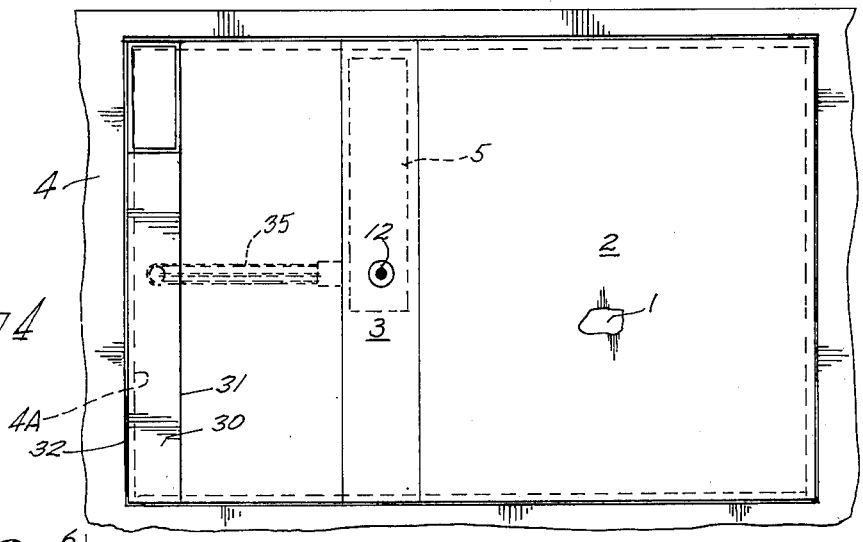

For imparting motion to arm 8 in an intermittent, cyclic manner a cam plate 13 pivotally mounts the outer end of a telescopic arm extension 9. A motor 14 (FIG. 2) is in engagement engagemennt with a speed reducing gear box 15, the latter secured to a mounting plate 16 in place on base component 6. An output shaft 17 of the gear box extends through plate 16 to receive cam plate 13. Switch means comprises a switch arm 20 pivotally supported at 21 by plate 16. A mercury switch 22 is supported on one end of the switch arm and moves with the lever in response to the action of a follower 23 in riding contact with the perimeter of cam plate 13. A spring 24 urges follower 23 into downward contact with the plate edge and importantly into a cam plate recess 13A to open mercury switch 22. The forward or distal end 20A of lever 20 terminates within an opening 1A formed within a platform member to allow the lever end to be in close proximity below a portion of flexible scuff strip 3. Said portion may be suitably marked with indices as at 26 to identify the location of lever end 20A to permit actuation of same by the golfer's foot or club head to initiate motor operation by closing a circuit through a momentarily upwardly inclined mercury switch 22. A hinged plate 25 overlies the outer end of lever 20.

A hopper structure indicated at 30 includes walls 31 and 32 having an opening 35 into which the balls are dumped for gravitational passage along inclined raceways 34. The hopper structure is suitably secured to platform 1 and accordingly the platform and hopper may be said to be unitary for reasons later elaborated upon. A lowermost raceway terminates in communication with a wire raceway 35 which extends downwardly and thence laterally in inclined fashion, the terminal portion of the last mentioned raceway being viewed in FIG. 5.

Figure 5:
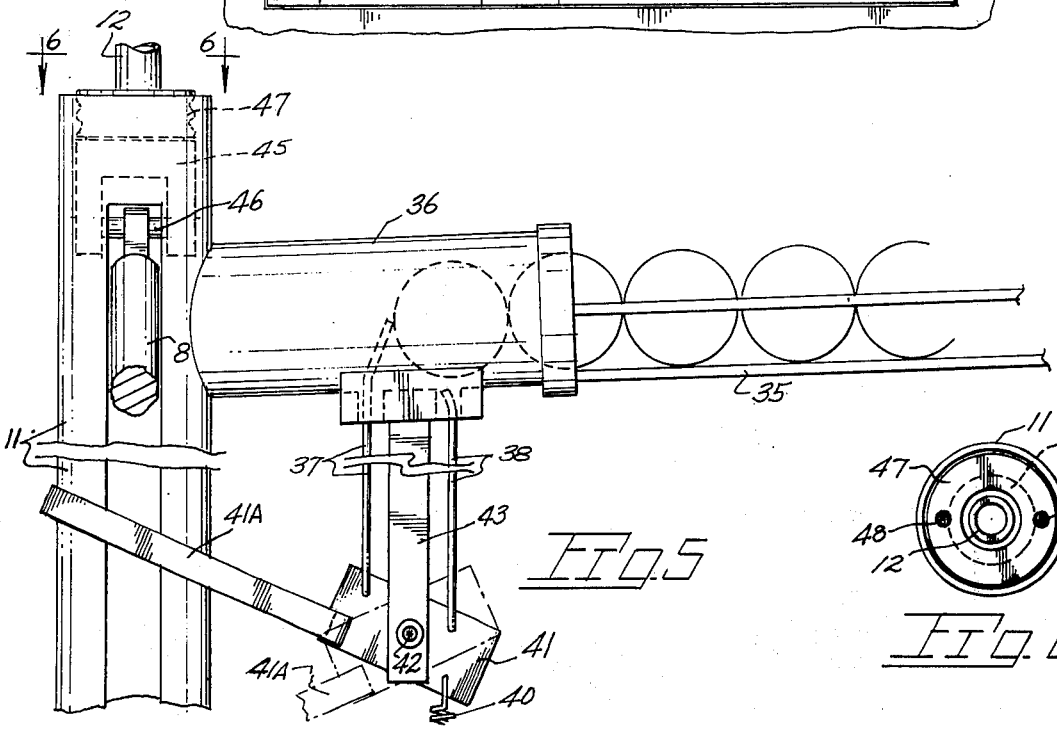
FIG. 5 is an elevational view taken along line 5—5 of FIG. 1 showing details of ball release means.
Figure 6:
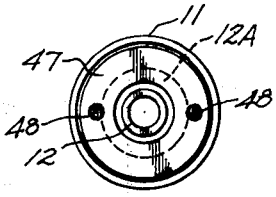
FIG. 6 is a plan view taken along line 6—6 of FIG. 5.

Ball guide means 10 additionally includes a ball release mechanism as shown in FIG. 5 for sequential release of golf balls permitting their gravitation into engagement with tee 12. A tubular arm 36 of the ball guide means extends in a slightly inclined manner from cylindrical ball guide 11. Arm 36 carries on its underside ball release means including reciprocating plungers 37 and 38. First plunger 37 is urged to an extended, ball stopping position by means of a spring 40 acting on a toggle plate 41. Said toggle plate is pivotally mounted at 42 to a support 43 suitably secured to arm 36. A second plunger 38 is extended in an alternating manner with the first mentioned plunger by means of a toggle arm 41A disposed so as to be actuated by arm 8 during its downward stroke during its cycle of operation. Accordingly, downward movement of arm 41A causes plunger 37 to be retracted releasing a golf ball while simultaneously upward movement of second plunger 38 positions same so as to block the following ball. During the return stroke of arm 8 spring 40 urges toggle plate 41 to the full line position shown in FIG. 5 to permit the first mentioned plunger to return to its starting position whereat it blocks the golf ball temporarily blocked by plunger 38 until a second cycle is started. The upper ends of plungers 37 and 38 are canted for the purpose of avoiding jamming contact with a golf ball.

The earlier mentioned tee assembly comprises a tee carrier 45 bifurcated at its lower end to mount a pin 46 slidably engaged by arm end 8A. As viewed in FIG. 5, the upper end of carrier 45 is shouldered and externally threaded to receive a correspondingly threaded ring 47 which serves to confine the flat base 12A of flexible tee 12. A pair of sockets 48 formed in ring 47 receive a spanner type wrench facilitating ring removal and replacement of flexible tee 12 which replacement may be either shorter or longer depending upon the type of golf shot being practiced.

The operation is believed apparent from the foregoing description.

While I have shown but one embodiment of the invention it will be apparent to those skilled in the art that the invention may be embodied still otherwise without departing from the spirit and scope of the invention.

Having thus described the invention what is desired to be secured under a Letters Patent is:

1. A golf ball teeing device comprising, a platform on which the golfer stands, a base disposed below said platform, arm means rockably mounted on said base, a tee assembly supported by said base and coupled to one end of said arm means and thereby actuated in a reciprocating manner during rocking motion of the arm to position a golf ball above the platform, arm actuating means for cyclic oscillation of the arm means, said arm actuating means including a circular cam plate having a recessed area defined by its outer periphery, a switch arm including follower means in riding contact with the cam plate, a switch carried by said switch arm in circuit with a motor driving said cam plate and with an electrical source, said switch arm disposed subjacent said platform and including an arm segment disposed within a platform opening permitting actuation of the switch arm by the golfer to close the arm carried switch to initiate motor operation, said arm carried switch opened to stop motor operation upon said follower means engaging the cam plate defined recess, and ball guide means communicating a gravitating supply of golf balls to said tee assembly and including a ball release mechanism actuated by said rockably mounted arm means during each cycle of operation to sequentially release golf balls to the tee assembly.

2. The golf ball teeing device claimed in claim 1 wherein said rockably mounted arm means comprises telescoping arm members.

3. The golf ball teeing device claimed in claim 1 wherein said ball release mechanism includes a toggle arm disposed within the path of said rockably mounted arm means for release of a golf ball to the tee assembly during each cycle of arm operation.

* * * * *